US006820301B2

(12) United States Patent
Petner

(10) Patent No.: US 6,820,301 B2
(45) Date of Patent: Nov. 23, 2004

(54) CLEANING IMPLEMENT WITH REMOVABLE CLEANING ELEMENT

(75) Inventor: Robert E. Petner, Burlington, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 363 days.

(21) Appl. No.: 10/140,465

(22) Filed: May 7, 2002

(65) Prior Publication Data

US 2003/0217426 A1 Nov. 27, 2003

(51) Int. Cl.[7] ..... B25G 3/12
(52) U.S. Cl. ..... 15/145; 16/422; 403/305
(58) Field of Search ..... 15/145; 16/422, 16/429, 436, DIG. 41; 403/300–305, 326, 329, 365, 368, 370

(56) References Cited

U.S. PATENT DOCUMENTS

| | | | | | |
|---|---|---|---|---|---|
| 34,687 | A | | 3/1862 | Horton | 15/151 |
| 47,642 | A | | 5/1865 | Homes | 15/153 |
| 112,556 | A | | 3/1871 | David | 15/153 |
| 349,678 | A | * | 9/1886 | Applegate | 403/300 |
| 538,269 | A | | 4/1895 | Neagles | 15/147.1 |
| 798,172 | A | * | 8/1905 | Ducret | 279/99 |
| 1,182,288 | A | * | 5/1916 | Mack | 403/370 |
| 1,229,843 | A | * | 6/1917 | Whitaker | 279/91 |
| 1,420,639 | A | | 6/1922 | Sturgis | 15/147.2 |
| 1,530,225 | A | * | 3/1925 | Belakoy | 403/365 |
| 1,934,910 | A | | 11/1933 | Buhr | 279/105.1 |
| 3,423,781 | A | | 1/1969 | Henson | 15/145 |
| 3,600,735 | A | | 8/1971 | Jerabek | 15/49.1 |
| 3,682,516 | A | | 8/1972 | Savage | 403/189 |
| 3,795,934 | A | | 3/1974 | Moss | 15/229.2 |
| 4,132,489 | A | | 1/1979 | Berg, Jr. et al. | 403/305 |
| 4,433,931 | A | | 2/1984 | Malish et al. | 403/194 |
| 4,524,484 | A | | 6/1985 | Graham | 16/429 |
| 4,541,139 | A | | 9/1985 | Jones et al. | 15/171 |
| 4,642,837 | A | | 2/1987 | Nichols et al. | 15/171 |
| 4,648,738 | A | | 3/1987 | Thielen | 403/341 |
| 4,794,663 | A | | 1/1989 | Vosbikian | 15/229.6 |
| 5,037,235 | A | | 8/1991 | Aquilina | 403/290 |
| 5,161,278 | A | | 11/1992 | Tomm | 15/159.1 |
| 5,172,447 | A | | 12/1992 | Tomm | 15/159.1 |
| 5,358,524 | A | | 10/1994 | Richelsoph | 623/23.47 |
| 5,579,848 | A | * | 12/1996 | Hsu | 172/378 |
| 5,890,254 | A | | 4/1999 | Courtney et al. | 15/145 |
| 5,924,816 | A | | 7/1999 | Schuele | 403/371 |
| 5,940,933 | A | | 8/1999 | Chang | 15/144.4 |
| 5,970,567 | A | | 10/1999 | Hirse | 15/229.2 |
| 6,006,399 | A | | 12/1999 | Massaro | 15/315 |
| 6,029,308 | A | | 2/2000 | Smith | 15/229.2 |
| 6,115,869 | A | | 9/2000 | Libman | 15/120.1 |
| 6,125,494 | A | | 10/2000 | Morad | 15/120.2 |
| 6,247,199 | B1 | | 6/2001 | Petner | 15/229.1 |
| 6,254,303 | B1 | | 7/2001 | Falat et al. | 403/348 |
| 6,279,961 | B1 | | 8/2001 | Stoltz | 285/7 |
| 2001/0013150 | A1 | | 8/2001 | Specht | 15/120.2 |

* cited by examiner

*Primary Examiner*—Mark Spisich
(74) *Attorney, Agent, or Firm*—Wildman, Harrold, Allen & Dixon LLP

(57) ABSTRACT

Disclosed is a cleaning implement with a removable cleaning element comprising a base member having a first end with an annular toothed edge and at least one resilient retention member positioned intermediate the toothed edge and a second end of the base member, each resilient retention member having a stop surface facing the second end. An annular locking member is movably mounted on the base member, the locking member having an inner wall surface and at least one ledge projecting from the inner wall surface and adapted to abut the retention member stop surface. The inner wall surface of the locking member further includes a threaded portion intermediate an end of the locking member and the ledge. Also included is a cleaning element mounting member having an annular toothed edge for complementary engagement with the toothed edge of the base member and an outer wall surface with a threaded portion for threaded engagement with the threaded portion of the locking member. A cleaning element in the form of a mop head may be secured to the mounting member. The cleaning implement may be movably secured to an elongated handle.

18 Claims, 3 Drawing Sheets

CLEANING IMPLEMENT WITH REMOVABLE CLEANING ELEMENT

The present invention relates to a cleaning implement having a cleaning element mounted on a removable mounting member.

BRIEF DESCRIPTION OF THE DRAWINGS

In the drawings illustrating embodiments of the present invention.

DETAILED DESCRIPTION OF THE INVENTION

Figure 1:
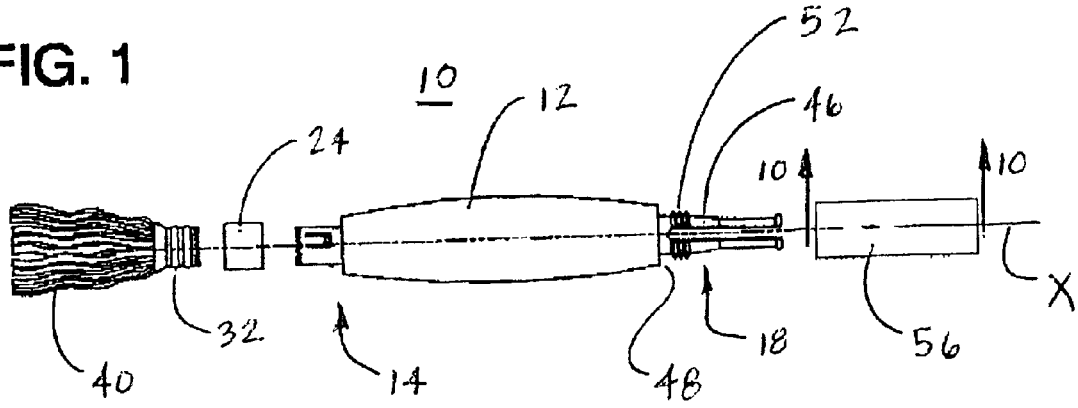
FIG. 1 is an exploded view of the cleaning implement of the present invention.
Figure 2:
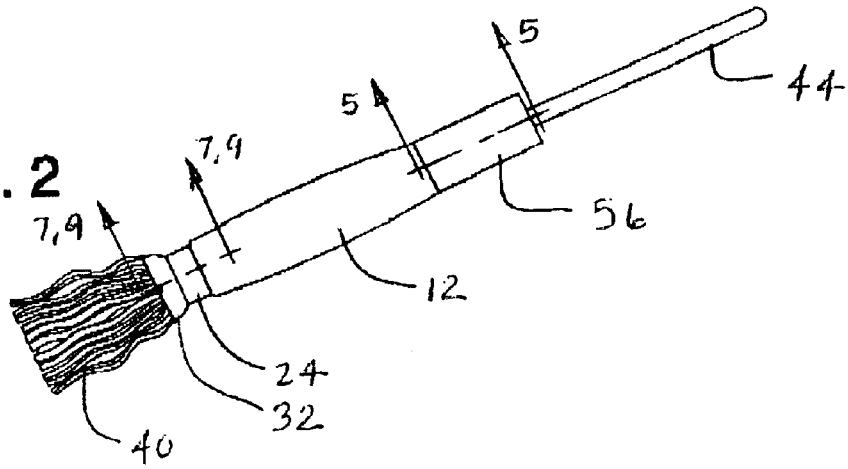
FIG. 2 is a perspective view showing the cleaning implement fully assembled and secured to an elongated handle.

Referring to FIGS. 1 and 2, cleaning implement 10 comprises a base member 12, a locking member 24, and a cleaning element mounting member 32 having a cleaning element 40 secured thereto. Cleaning element 40 may comprise a mop head, a bristle head of a broom, a squeegee or one of many other types of such cleaning elements. Base member 12 includes a first end 14 and a second end 18. In a first embodiment, base member 12 is of a generally annular construction defining a bore into which an elongated handle 44 is received so that base member 12 may be movably secured to handle 44. Alternatively, the cleaning implement may be used without being secured to the handle.

Figure 3:
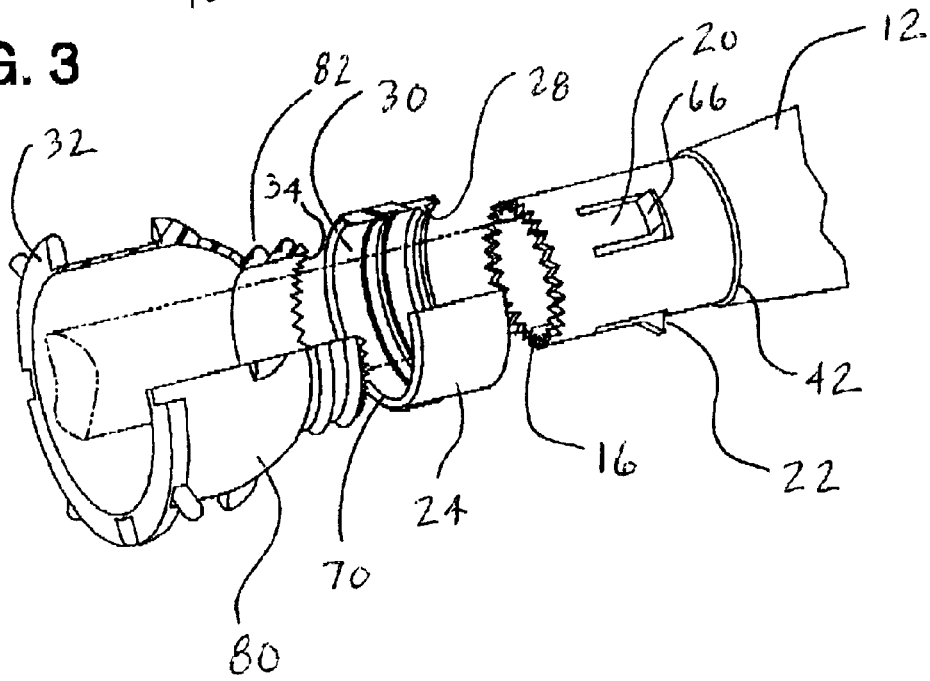
FIG. 3 is an exploded partial cutaway view of a first embodiment of the cleaning implement.

Referring to FIGS. 1 and 3, base member first end 14 includes an annular toothed edge 16 and one or more resilient retention members 20 positioned intermediate toothed edge 16 and base member second end 18. A shoulder 42 may be provided on base member 12 between retention members 20 and second end 18 for abutting a locking member ledge 28 and restricting movement of locking member 24 along base member 12 to within a range between retention members 20 and shoulder 42, in a manner to be described in more detail later.

As seen more clearly in FIG. 3, retention members 20 may have a cantilevered beam construction. Alternatively, retention members 20 may be supported at both ends, the portions of the retention members residing between the ends being designed to deflect under an applied load. Each resilient retention member 20 has a stop surface 22 facing second end 18. Stop surface 22 extends generally perpendicularly with respect to a longitudinal axis X of base member 12 (FIG. 1) and is configured for abutting locking member ledge 28 projecting from an inner wall surface of locking member 24, to be described in greater detail later. Each retention member 20 may also include an inclined surface 66 positioned between stop surface 22 and toothed edge 16. In a first embodiment of the cleaning implement shown in FIG. 3, a plurality of resilient retention members 20 is spaced evenly around an outer surface of first end 14.

Figure 5:
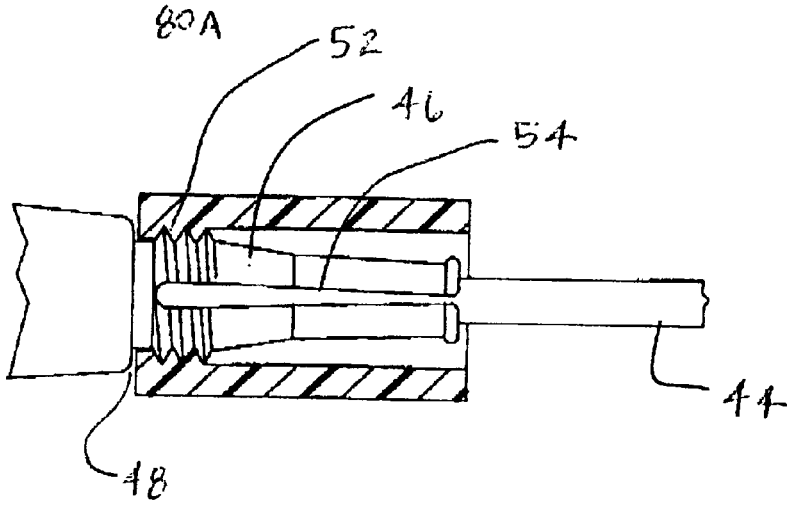
FIG. 5 is a cross-sectional view of a second end of the cleaning implement secured to a handle.

Referring to FIGS. 1, 2 and 5, if base member 12 is to be movably secured to elongated handle 44, base member second end 18 may include an annular portion 46 and a shoulder 48 intermediate annular portion 46 and retention members 20. Annular portion 46 has an outer wall surface including a threaded portion 52 proximate shoulder 48 and one or more slots 54 extending along annular portion 46 from base member second end 18 generally toward base member first end 14 and extending into threaded portion 52 of second end 18. Due to the presence of slots 54, parts of annular portion 46 adjacent the slots are unsupported and, therefore, relatively resilient.

Referring to FIGS. 1 and 3, an annular locking member 24 is movably mounted on base member 12. Locking member 24 has an inner wall surface and at least one ledge 28 projecting from the inner wall surface. Ledge 28 is adapted to abut retention member stop surfaces 22 when cleaning implement 10 is fully assembled. The inner wall surface of locking member 24 also includes a threaded portion 30 proximate an end of the locking member and between an end 70 of locking member 24 and ledge 28.

Mounting member 32 includes an outer wall surface 80 and an annular toothed edge 34 for complementary engagement with toothed edge 16 of base member 12. Outer wall surface 80 has a threaded portion 82 for threaded engagement with threaded portion 30 of locking member 24, in a manner described in greater detail later. A cleaning element 40 is secured to mounting member 32 using any one of a variety of known methods. Generally, cleaning element 40 is permanently affixed to mounting member 32 to produce a unitary cleaning element sub-assembly.

Figure 10:
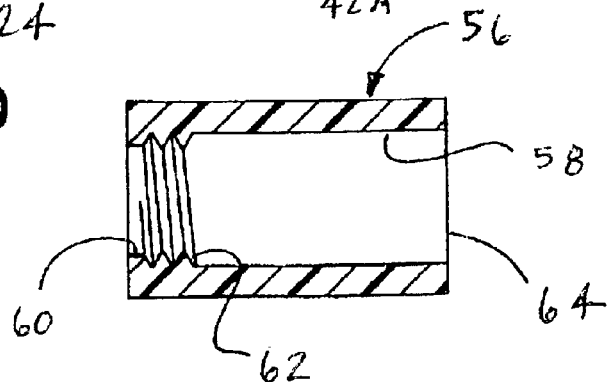
FIG. 10 is a cross-sectional view of a second locking member as seen in FIG. 5.
Figure 1:
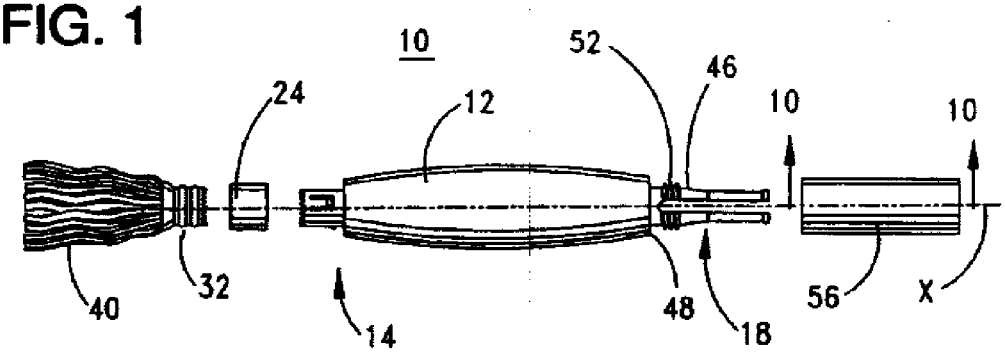
Figure 2:
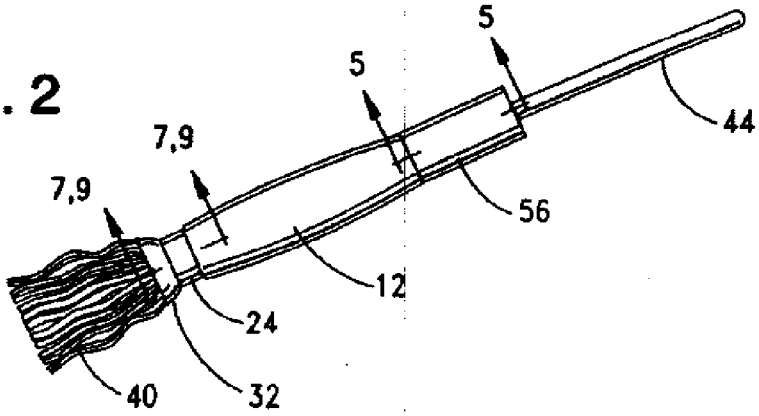
Figure 3:
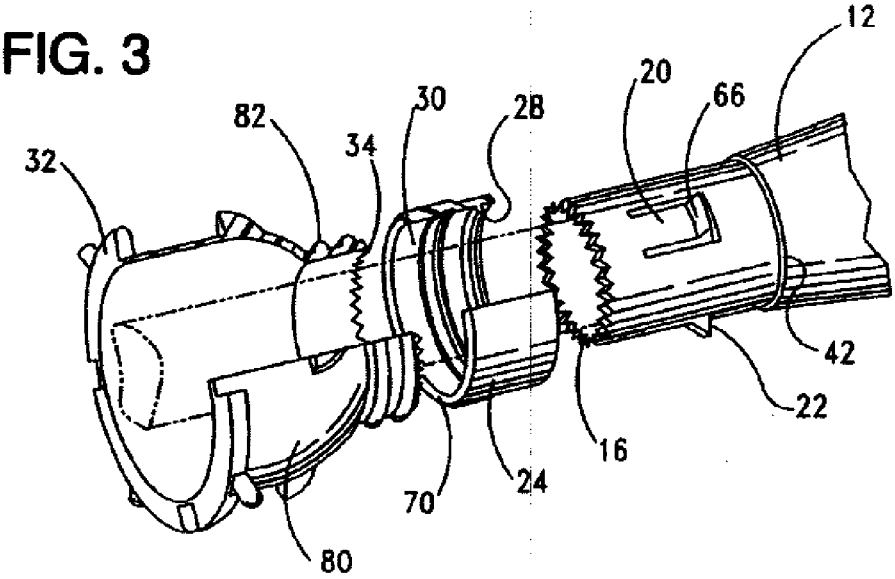
Figure 4:
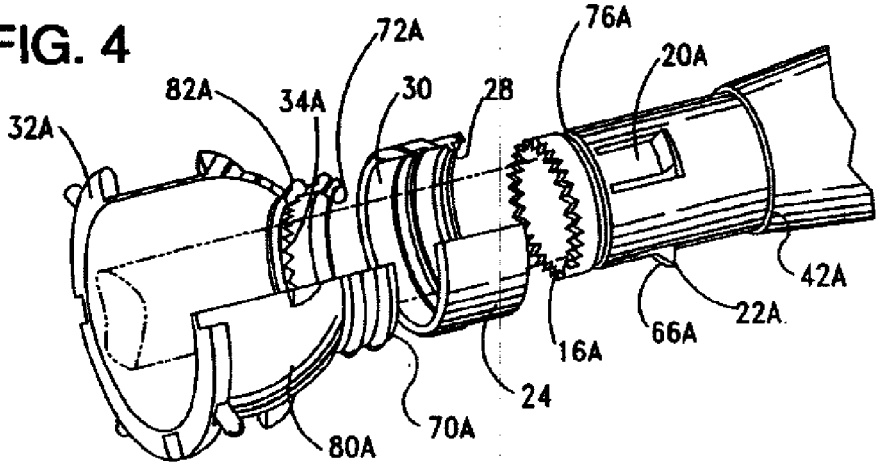
Figure 5:
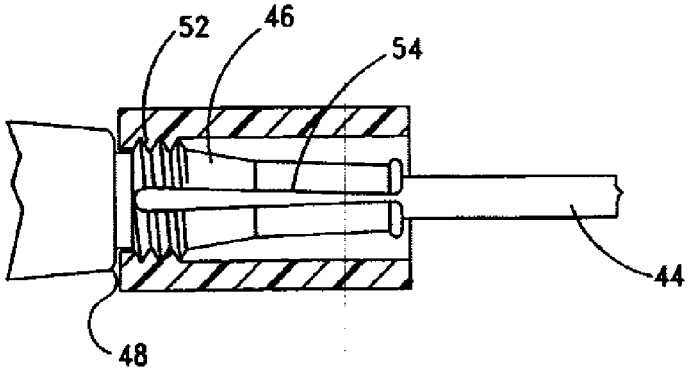
Figure 6:
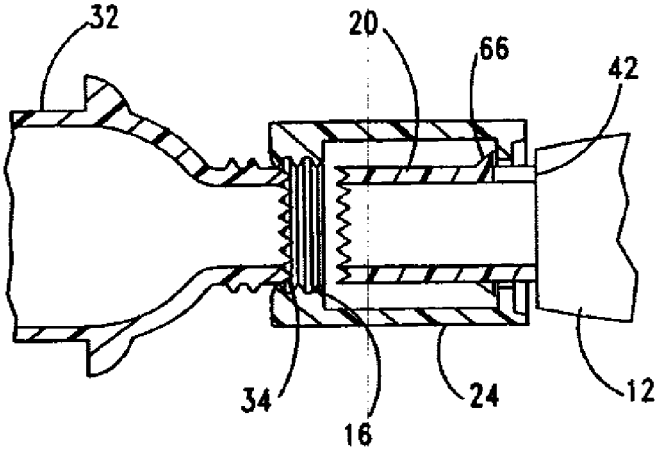
Figure 7:
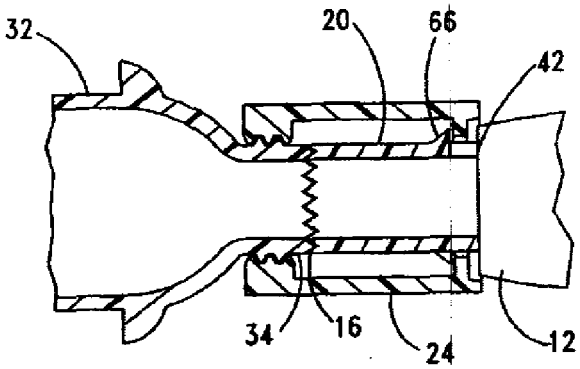
Figure 8:
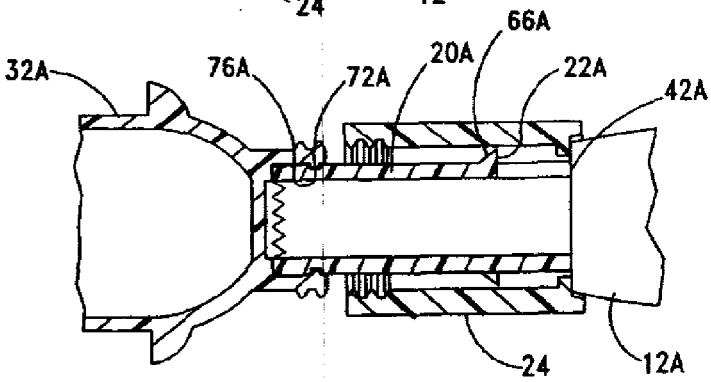
Figure 9:
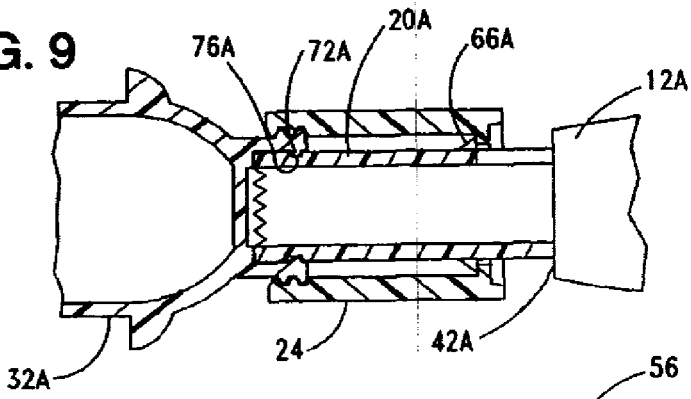
Figure 10:
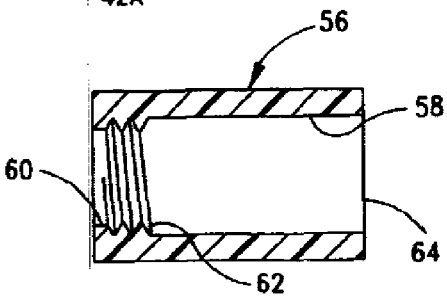

As seen in FIGS. 1 and 2, if base member 12 is to be movably secured to elongated handle 44, a second annular locking member 56 is movably mounted on base member 12 along annular portion 46. Referring to FIG. 10, second locking member 56 has an inner wall surface 58 and at least one ledge 60 projecting from inner wall surface 58. Ledge 60 is adapted to abut shoulder 48 when cleaning implement 10 is assembled, thereby restricting movement of second locking member 56 along base member 12. A threaded portion 62 extends along inner wall surface 58 intermediate an end 64 of second locking member 56 and ledge 60 for threaded engagement with threaded portion 52 of the annular portion outer wall surface (see FIG. 1).

The steps involved in assembling cleaning implement 10 will now be discussed. Referring to FIGS. 5 and 10, to secure base member 12 to handle 44, handle 44 is inserted into base member and second locking member threaded portion 62 is placed in contact with base member second end threaded portion 52 to enable engagement between the threaded portions. Second locking member 56 is then rotated with respect to base member second end threaded portion 52 to engage second locking member threaded portion 62. Engagement between threaded portion 52 of the annular portion outer wall surface and second locking member threaded portion 62 causes annular portion 46 on either side of slots 54 into compressive contact with elongated handle 44. This contact secures base member 12 to elongated handle 44.

Figure 6:
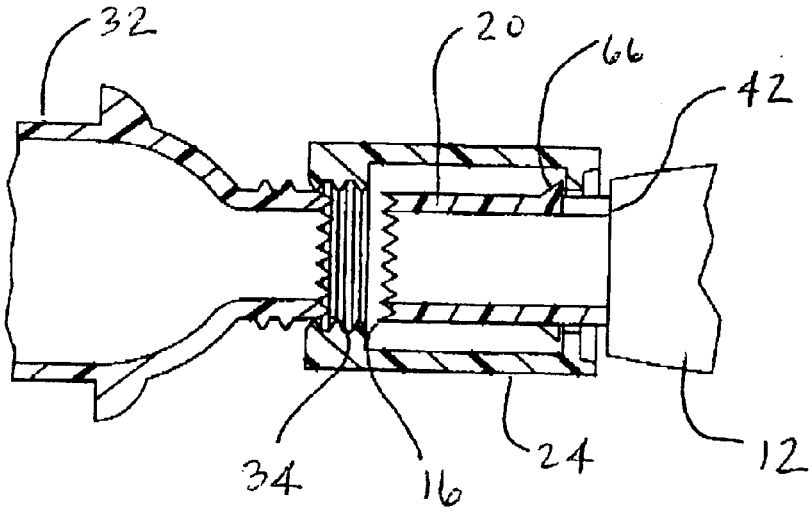
FIG. 6 is a cross-sectional view of the embodiment of the cleaning implement of FIG. 3 partially assembled.

Referring to FIGS. 1, 3 and 6, to assemble locking member 24 to base member 12, locking member 24 is placed over base member first end 14 such that first end 14 extends through locking member 24. Locking member 24 is urged toward base member second end 18 until it engages inclined surfaces 66 (if present), causing unsupported portions of retention members 20 to deflect inward toward handle 44. Locking member 24 thus slides over retention members 20 toward second end 18 of base member 12 until locking member 24 has passed over retention members 20, allowing retention members 20 to return to their undeflected states. At this point, movement of locking member 24 back toward base member first end 14 will eventually bring locking member ledge 28 in abutting contact with stop surfaces 22, thereby preventing further movement of locking member 24 in that direction. In addition, movement of locking member 24 toward base member second end 18 will eventually bring locking member ledge 28 in abutting contact with shoulder 42, thereby preventing further movement of locking member 24 in that direction. Movement of locking member 24 on base member 12 is thereby restricted to within a range between retention members 20 and shoulder 42, as indicated by dimension Y shown in FIG. 3.

Figure 7:
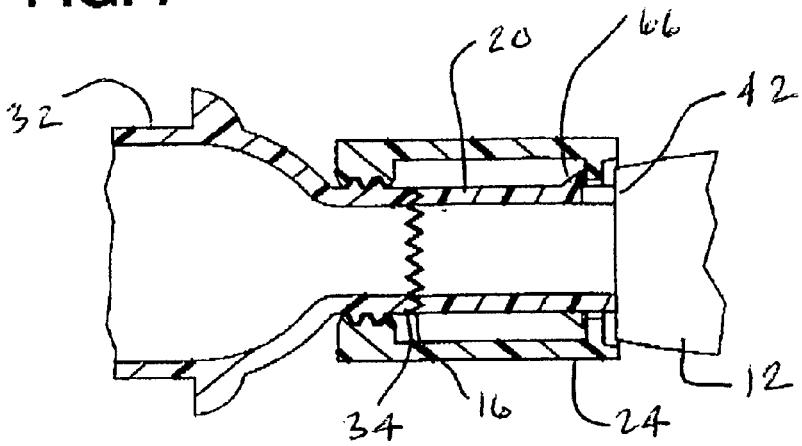
FIG. 7 is a cross-sectional view of the embodiment of the cleaning implement of FIG. 3 fully assembled.

Referring to FIG. 7, in a first embodiment mounting member 32 is removably attached to base member 12 as follows. Threaded portion 82 of mounting member 32 is brought into contact with threaded portion 30 of locking member 24. As a user holds mounting member 32 in contact with locking member 24, locking member 24 is rotated with respect to mounting member 32, causing locking member threaded portion 30 to engage corresponding threaded portion 82 on mounting member 32, thereby urging mounting member 32 toward base member 12. As mounting member 32 moves toward base member 12, mounting member toothed edge 34 moves toward engagement with base member toothed edge 16 and locking member ledge 28 moves toward, and eventually comes into contact with, stop surfaces 22 of retention members 20.

When mounting member toothed edge 34 and base member toothed edge 16 become engaged (i.e., when the teeth of one toothed edge extend at least partially into corresponding cavities in the other toothed edge), rotation of mounting member 32 with respect to base member 12 will be substantially restricted to a degree depending on the depth of the engagement and the sizes of the teeth. At the point where teeth of one toothed edge extend completely into corresponding cavities in the other toothed edge, rotation of mounting member 32 with respect to base member 12 should be prevented completely.

As rotation of locking member 24 continues past the point at which the toothed edges become completely engaged, locking member ledge 28 is urged toward stop surfaces 22 on retention members 20 until locking member ledge 28 comes into contact with stop surfaces 22. When locking member ledge 28 abuts stop surfaces 22 and base member toothed edge 16 is completely engaged with mounting member toothed edge 34, mounting member 32 is removably secured to base member 12.

As noted above, cleaning element 40 is generally permanently affixed to mounting member 32 to produce a unitary cleaning element assembly. When it is desired to replace the cleaning element, mounting member 32 is disengaged from base member 12 and discarded. A new cleaning element assembly is then attached to base member 12 as described above. To remove mounting member 32 to which a used cleaning element is attached, locking member 24 is rotated about base member 12 in a direction appropriate to disengage the threaded portions of locking member 24 and mounting member 32. Rotation is continued until the locking member and mounting member threaded portions become completely disengaged, enabling a user to remove mounting member 32 from locking member 24.

Figure 4:
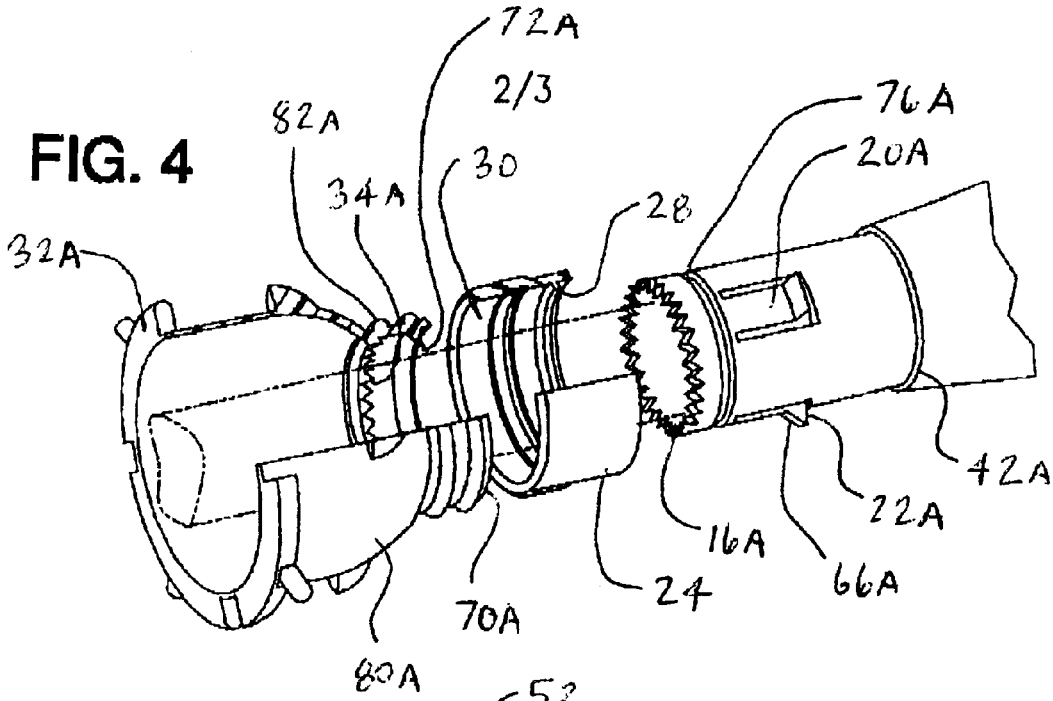
FIG. 4 is an exploded partial cutaway view of a second embodiment of the cleaning implement.

The structure of a second embodiment of the invention will now be described. Referring to FIG. 4, mounting member annular toothed edge 34A projects from an inner wall surface of mounting member 32A between a first end 80A and a second end 70A of mounting member 32A. In this embodiment, a detent system may be incorporated to maintain toothed edges 16A and 34A in engagement during engagement of locking member threaded portion 30 with mounting member threaded portion 82A. The detent system comprises at least one ledge 72A projecting from the inner wall surface of mounting member 32A intermediate toothed edge 34A and end 80A of mounting member 32A, and a groove 76A positioned in an outer wall surface of base member 12A between toothed edge 16A and retention members 20A.

Groove 76A is configured to receive ledge 72A therein such that a snap-fit is created between groove 76A and ledge 72A when toothed edges 34A and 16A are engaged, thereby maintaining toothed edges 34A and 16A in an engaged position while locking member 24 is rotated by a user to engage locking member threaded portion 30 with mounting member threaded portion 82A.

Figure 8:
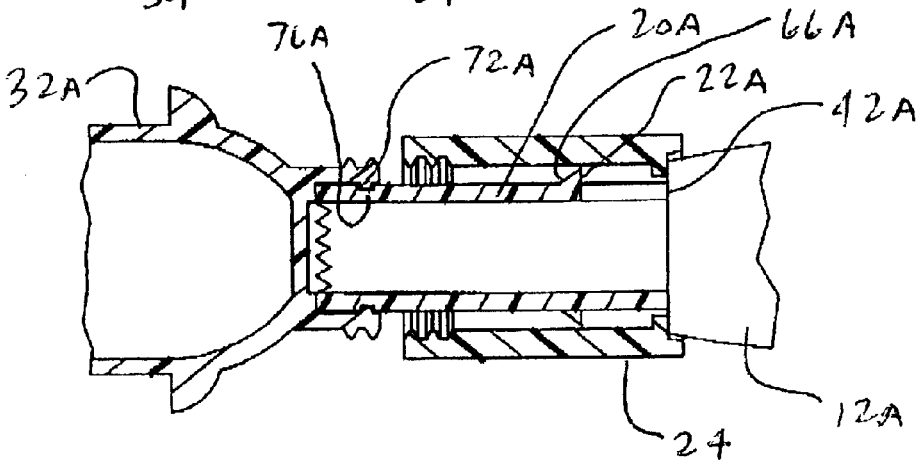
FIG. 8 is a cross-sectional view of the embodiment of the cleaning implement of FIG. 4 partially assembled.
Figure 9:
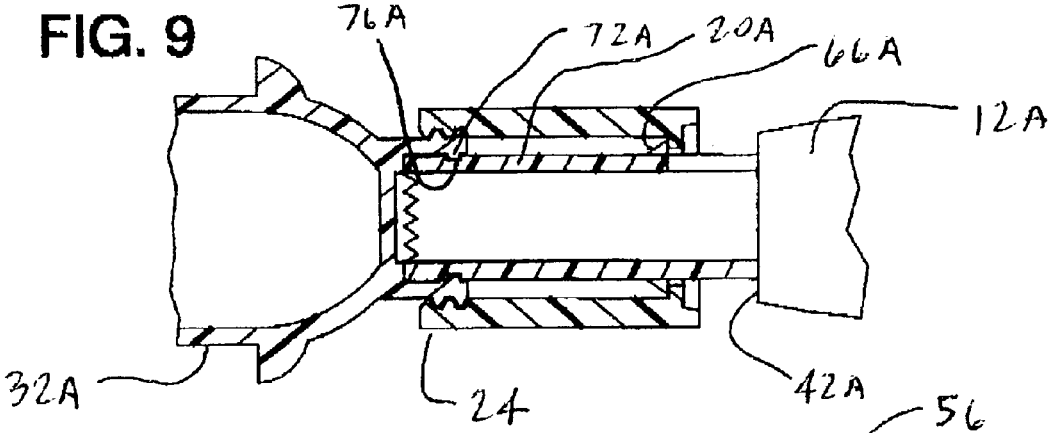
FIG. 9 is a cross-sectional view of the embodiment of the cleaning implement of FIG. 4 fully assembled.

Assembly of the second embodiment will now be described. Referring to FIGS. 4, 8 and 9, mounting member toothed edge 34A and base member toothed edge 16A are engaged prior engagement of locking member threaded portion 30 with mounting member threaded portion 82A. In this embodiment, mounting member 32A is removably attached to base member 12A as follows. Base member first end 12A is inserted into mounting member 32A as shown in FIG. 7 to bring base member toothed edge 16A into engagement with mounting member toothed edge 34A. As base member toothed edge 16A engages mounting member toothed edge 34A, mounting member ledge 72A also engages base member groove 76A in a snap fit.

Engagement between mounting member ledge 72A and base member groove 76A acts to maintain the engagement between the toothed edges of mounting member 32A and base member first end 14A, eliminating the need for a user to hold the toothed edges in contact during application of locking member threaded portion 30 to mounting member threaded portion 82A. At this point, locking member 24 either abuts shoulder 42A or resides in a position recessed from base member first end 14A such that it does not interfere with engagement between the mounting member toothed edge 34A and the base member toothed edge 16A.

After the base member and mounting member toothed edges are engaged, locking member 24 is brought into contact with mounting member 32A so as to enable locking member threaded portion 30 to engage mounting member threaded portion 82A. Locking member 24 is then rotated so as to engage locking member threaded portion 30 and mounting member threaded portion 82A. As rotation continues, locking member ledge 28 is urged toward stop surfaces 22A of retention members 20A. When locking member ledge 28 abuts stop surfaces 22A and base member toothed edge 16A is engaged with mounting member toothed edge 34A, mounting member 32A is removably secured to base member 12A.

It should be understood that the preceding is merely a detailed description of one embodiment of this invention and that numerous changes to the disclosed embodiment can be made in accordance with the disclosure herein without departing from the spirit or scope of the invention. The preceding description, therefore, is not meant to limit the scope of the invention. Rather, the scope of the invention is to be determined only by the appended claims and their equivalents.

What is claimed is:

1. A cleaning implement with a removable cleaning element comprising:

a base member having a first end with an annular toothed edge and at least one resilient retention member positioned intermediate the toothed edge and a second end of the base member, each resilient retention member having a stop surface facing the second end;

an annular locking member movably mounted on the base member, the locking member having an inner wall surface and at least one ledge projecting from the inner wall surface and adapted to abut the retention member stop surface, the inner wall surface further including a threaded portion intermediate an end of the locking member and the at least one ledge;

a cleaning element mounting member having an annular toothed edge for complementary engagement with the toothed edge of the base member and an outer wall surface with a threaded portion for threaded engagement with the threaded portion of the locking member.

2. The cleaning implement of claim 1 wherein the cleaning element comprises a mop head.

3. The cleaning implement of claim 1 wherein the base member further comprises a shoulder intermediate the at least one retention member and the base member second end adapted for abutting the at least one locking member ledge for restricting movement of the locking member on the base member to within a range between the at least one retention member and the shoulder.

4. The cleaning implement of claim 1 wherein the base member is movably secured to an elongated handle.

5. The cleaning implement of claim 4 wherein the base member second end includes an annular portion and a shoulder intermediate the annular portion and the at least one retention member, the annular portion having an outer wall surface including a threaded portion and at least one slot extending along the annular portion from the base member second end generally toward the base member first end and extending into the threaded portion of the second end; and a second annular locking member movably mounted on the base member along the annular portion, the second locking member having an inner wall surface and at least one ledge projecting from the inner wall surface and adapted to abut the shoulder, the inner wall surface also having a threaded portion intermediate an end of the second locking member and the at least one ledge for threaded engagement with the threaded portion of the annular portion outer wall surface, such that engagement between the threaded portion of the annular portion outer wall surface and the second locking member inner wall surface threaded portion urges the annular portion on either side of each slot into contact with the elongated handle, securing the base member to the elongated handle.

6. The cleaning implement of claim 1 wherein the at least one resilient retention member has a cantilevered beam construction.

7. The cleaning implement of claim 1 wherein the at least one retention member further comprises an inclined surface positioned intermediate the stop surface and the toothed edge.

8. The cleaning implement of claim 1 wherein the base member toothed edge and the mounting member toothed edge are engaged to prevent rotation of the mounting member with respect to the base member.

9. The cleaning implement of claim 8 wherein the mounting member annular toothed edge projects from an inner wall surface of the mounting member between a first end and a second end of the mounting member.

10. The cleaning implement of claim 9 wherein at least one ledge projects from the inner wall surface of the mounting member intermediate the toothed edge and an end of the mounting member and the first end of the base member includes an outer wall surface with a groove positioned intermediate the toothed edge of the base member and the at least one resilient retention member for receiving therein the at least one ledge projecting from the inner wall surface of the mounting member.

11. The cleaning implement of claim 1 wherein a plurality of retention members is substantially evenly spaced around an outer surface of the base member first end.

12. A connection system for interconnecting two members of an implement comprising:

an annular toothed edge mounted to a first end of a base member;

at least one resilient retention member positioned intermediate the toothed edge and a second end of the base member, the at least one resilient retention member having a stop surface facing the base member second end;

an annular locking member movably mounted on the base member and having an inner wall surface with at least one ledge projecting from the inner wall surface adapted to abut the stop surface on the at least one resilient retention member, the inner wall surface including a threaded portion intermediate an end of the locking member and the at least one ledge; and a mounting member having an annular toothed edge for complementary engagement with the toothed edge of the base member and an outer wall surface with a threaded portion for threaded engagement with the threaded portion of the locking member.

13. The connection system of claim 12 further comprising a shoulder intermediate the at least one retention member and the second end adapted to abut the locking member ledge for restricting movement of the locking member on the base member to a range between the at least one retention member and the shoulder.

14. The connection system of claim 12 wherein the at least one resilient retention member has a cantilevered beam construction.

15. The connection system of claim 12 wherein the at least one retention member further comprises an inclined surface positioned intermediate the stop surface and the toothed edge.

16. The connection system of claim 12 wherein the base member toothed edge and the mounting member toothed edge are engaged to prevent rotation of mounting member with respect to the base member.

17. The connection system of claim 16 wherein the mounting member annular toothed edge projects from an inner wall surface of the mounting member between a first end and a second end of the mounting member.

18. The connection system of claim 17 wherein at least one ledge projects from the inner wall surface of the mounting member intermediate the toothed edge and an end of the mounting member and the first end of the base member includes an outer wall surface with a groove positioned intermediate the toothed edge of the base member and the at least one resilient retention member for receiving therein the at least one ledge projecting from the inner wall surface of the mounting member.

* * * * *

UNITED STATES PATENT AND TRADEMARK OFFICE

CERTIFICATE OF CORRECTION

PATENT NO. : 6,820,301 B2
DATED : November 23, 2004
INVENTOR(S) : Petner

It is certified that error appears in the above-identified patent and that said Letters Patent is hereby corrected as shown below:

Title page,
Illustrating figure(s) should be deleted, and substitutes therefore, the title page illustrating figure(s). (attached)

Drawings,
Delete sheets 1-3, and substitute therefore, drawing sheets 1-3. (attached)

Signed and Sealed this

Third Day of May, 2005

JON W. DUDAS
*Director of the United States Patent and Trademark Office*

(12) United States Patent
Petner

(10) Patent No.: US 6,820,301 B2
(45) Date of Patent: Nov. 23, 2004

(54) CLEANING IMPLEMENT WITH REMOVABLE CLEANING ELEMENT

(75) Inventor: Robert E. Petner, Burlington, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 363 days.

(21) Appl. No.: 10/140,465

(22) Filed: May 7, 2002

(65) Prior Publication Data

US 2003/0217426 A1 Nov. 27, 2003

(51) Int. Cl.[7] ..... B25G 3/12

(52) U.S. Cl. ..... 15/145; 16/422; 403/305

(58) Field of Search ..... 15/145; 16/422, 16/429, 436, DIG. 41; 403/300–305, 326, 329, 365, 368, 370

(56) References Cited

U.S. PATENT DOCUMENTS

| | | | | | |
|---|---|---|---|---|---|
| 34,687 | A | | 3/1862 | Horton | 15/151 |
| 47,642 | A | | 5/1865 | Homes | 15/153 |
| 112,556 | A | | 3/1871 | David | 15/153 |
| 349,678 | A | * | 9/1886 | Applegate | 403/300 |
| 538,269 | A | | 4/1895 | Neagles | 15/147.1 |
| 798,172 | A | * | 8/1905 | Ducret | 279/99 |
| 1,182,288 | A | * | 5/1916 | Mack | 403/370 |
| 1,229,843 | A | * | 6/1917 | Whitaker | 279/91 |
| 1,420,639 | A | | 6/1922 | Sturgis | 15/147.2 |
| 1,530,225 | A | * | 3/1925 | Belakoy | 403/365 |
| 1,934,910 | A | | 11/1933 | Buhr | 279/105.1 |
| 3,423,781 | A | | 1/1969 | Henson | 15/145 |
| 3,600,735 | A | | 8/1971 | Jerabek | 15/49.1 |
| 3,682,516 | A | | 8/1972 | Savage | 403/189 |
| 3,795,934 | A | | 3/1974 | Moss | 15/229.2 |
| 4,132,489 | A | | 1/1979 | Berg, Jr. et al. | 403/305 |
| 4,433,931 | A | | 2/1984 | Malish et al. | 403/194 |
| 4,524,484 | A | | 6/1985 | Graham | 16/429 |
| 4,541,139 | A | | 9/1985 | Jones et al. | 15/171 |
| 4,642,837 | A | | 2/1987 | Nichols et al. | 15/171 |
| 4,648,738 | A | | 3/1987 | Thielen | 403/341 |
| 4,794,663 | A | | 1/1989 | Vosbikian | 15/229.6 |
| 5,037,235 | A | | 8/1991 | Aquilina | 403/290 |
| 5,161,278 | A | | 11/1992 | Tomm | 15/159.1 |
| 5,172,447 | A | | 12/1992 | Tomm | 15/159.1 |
| 5,358,524 | A | | 10/1994 | Richelsoph | 623/23.47 |
| 5,579,848 | A | * | 12/1996 | Hsu | 172/378 |
| 5,890,254 | A | | 4/1999 | Courtney et al. | 15/145 |
| 5,924,816 | A | | 7/1999 | Schuele | 403/371 |
| 5,940,933 | A | | 8/1999 | Chang | 15/144.4 |
| 5,970,567 | A | | 10/1999 | Hirse | 15/229.2 |
| 6,006,399 | A | | 12/1999 | Massaro | 15/315 |
| 6,029,308 | A | | 2/2000 | Smith | 15/229.2 |
| 6,115,869 | A | | 9/2000 | Libman | 15/120.1 |
| 6,125,494 | A | | 10/2000 | Morad | 15/120.2 |
| 6,247,199 | B1 | | 6/2001 | Petner | 15/229.1 |
| 6,254,303 | B1 | | 7/2001 | Falat et al. | 403/348 |
| 6,279,961 | B1 | | 8/2001 | Stoltz | 285/7 |
| 2001/0013150 | A1 | | 8/2001 | Specht | 15/120.2 |

* cited by examiner

*Primary Examiner*—Mark Spisich
(74) *Attorney, Agent, or Firm*—Wildman, Harrold, Allen & Dixon LLP

(57) ABSTRACT

Disclosed is a cleaning implement with a removable cleaning element comprising a base member having a first end with an annular toothed edge and at least one resilient retention member positioned intermediate the toothed edge and a second end of the base member, each resilient retention member having a stop surface facing the second end. An annular locking member is movably mounted on the base member, the locking member having an inner wall surface and at least one ledge projecting from the inner wall surface and adapted to abut the retention member stop surface. The inner wall surface of the locking member further includes a threaded portion intermediate an end of the locking member and the ledge. Also included is a cleaning element mounting member having an annular toothed edge for complementary engagement with the toothed edge of the base member and an outer wall surface with a threaded portion for threaded engagement with the threaded portion of the locking member. A cleaning element in the form of a mop head may be secured to the mounting member. The cleaning implement may be movably secured to an elongated handle.

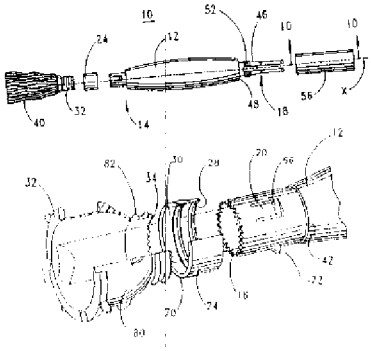

18 Claims, 3 Drawing Sheets